US005605475A

United States Patent [19]

Ogawa

[11] Patent Number: 5,605,475

[45] Date of Patent: Feb. 25, 1997

[54] ELECTRICAL CONNECTOR

[75] Inventor: Shinji Ogawa, Yokkaichi, Japan

[73] Assignee: Sumitomo Wiring Systems, Ltd., Japan

[21] Appl. No.: 361,312

[22] Filed: Dec. 21, 1994

[30] Foreign Application Priority Data

Dec. 21, 1993 [JP] Japan ..... 5-073596

[51] Int. Cl.[6] ..... H01R 13/74

[52] U.S. Cl. ..... 439/562; 439/311; 439/321

[58] Field of Search ..... 439/321, 320, 439/310, 562 OR, 564, 573, 572, 543, 551, 311

[56] References Cited

U.S. PATENT DOCUMENTS

| | | | |
|---|---|---|---|
| 3,307,138 | 2/1967 | Swartz | 439/320 |
| 4,152,039 | 5/1979 | Shah | 439/321 |
| 4,726,788 | 2/1988 | F'Geppert | 439/551 |
| 4,834,667 | 5/1989 | Fowler et al. | 439/321 |
| 4,900,260 | 2/1990 | Drogo | 439/321 |
| 5,035,640 | 7/1991 | Drogo | 439/321 |

FOREIGN PATENT DOCUMENTS

| | | |
|---|---|---|
| 63-211577 | 9/1988 | Japan . |
| 1415738 | 11/1975 | United Kingdom . |
| 1466940 | 3/1977 | United Kingdom . |

*Primary Examiner*—P. Austin Bradley
*Assistant Examiner*—Jeffrey T. Knapp
*Attorney, Agent, or Firm*—Banner & Witcoff, Ltd.

[57] ABSTRACT

A male screw portion 13 is formed on the outer circumferential surface of the connector 10, a female screw 22 is formed on the inner circumferential surface of the tube 21, and the two are screwed together to prevent withdrawal. A ratchet catch projection **15*a*1 is provided on the bottom surface of the arm 15*a* formed on the side of the connector body 10, arranged in such a way that it allows turning in the fastening direction with respect to the catch projection 24*a* of the lock member 24 formed on the edge of the opening 21*a***, and does not allow turning in the reverse direction.

10 Claims, 7 Drawing Sheets

ELECTRICAL CONNECTOR

BACKGROUND OF THE INVENTION

The present invention relates to an electrical connector, and particularly to a connector used for making an electrical connection through a wall.

A connector disclosed in Japanese Laid-Open Patent Application (Kokai) No. Sho 63-211577 is known for connection through a wall.

Such a connector is useful in making an electrical connection across a metal wall, and is retained by staking a portion of the wall into a recess of the connector. This type of connector is disadvantageous when considering modern materials and manufacturing techniques.

In particular, because a portion of the wall is bent for engagement with a recess of the connector, it has had to be formed from a metal material which does not recover when deformed, and which is able to retain its strength sufficiently in the deformed state. Materials, such as resins, which are difficult to bend into shape and in which the material itself has reduced strength are therefore inappropriate. Objects made from the resin are beginning to be demanded, in petrol tanks in particular, but it has not been possible to use the conventional connector arrangement for such resin articles.

Furthermore, the known staking operation requires a substantial force, and it has therefore not been possible to perform this operation without tools. The high forces involved may also lead to damage of components if they are not in the required angular orientation.

The present invention has taken the above problems into account and it aims to provide a connector with increased freedom of materials, and can thus be used with resin components or the like. In particular the invention does not require substantial assembly force and can improve the ease of assembly.

SUMMARY OF THE INVENTION

According to the invention there is provided an electrical connector in combination with a tube member of or for a wall, the tube member having an internal thread and the connector having an external thread for engagement therewith, wherein the connector and tube member have a seal therebetween, and engagement means to limit relative rotation thereof, said engagement means being engageable on contact between the mouth of said tube member and a portion of the body of said connector.

In operation, the connector is inserted into the tube member while being turned, and the two are screwed together. Turning of the connector is limited by the engaging mechanism when the connector body makes contact with the mouth of the tube member.

The present invention provides a connector which can improve the ease of assembly since it can be fitted simply by turning, and which is not limited to materials made of metals. The invention thus permits improved freedom of materials since it does not require staking or the like.

The combination may be configured in such a way that the engagement means has a ratchet mechanism which permits relative rotation in the fastening direction but prevents such rotation in the reverse direction.

The ratchet mechanism may have an arm having a projection, an angled portion of which faces to the rear in the direction of turning, and a lock member provided with a catch having an angled portion, said angled portions permitting relative rotation in the fastening direction but having abutment faces engageable to prevent rotation in the reverse direction.

The projection is preferably formed at the tip of a flexible arm, the arm flexing easily during fastening but engaging accurately against the catch of the lock member in the reverse direction. Alternatively, if the arm faces in the un-screwing direction, the lock member should also similarly face in the un-screwing direction, and if the arm faces in the diametral direction, the lock member should also face in the diametral direction.

The invention reliably stops looseness while facilitating turning in the fastening direction by means of the ratchet mechanism.

The combination may be configured in such a way that the said arm is formed on part of a flange formed on either the tube member or on the connector.

If the arm is provided on a flange, the flange construction itself may also be flexible, and the configuration of the ratchet mechanism is simplified. The flange may be circular and may have a projection formed on part thereof or projections formed over the whole of its circumference, or part of the flange may be extended in the diametral direction and the projection(s) formed on this or these portion(s). Furthermore, the flange may be partially reduced in thickness and thereby provided with flexible properties.

The ratchet arm thus has a simple configuration in which a projection engages a catch by means of the flexible arm member. The connector and tube member may be formed integrally from a resin or the like.

If the flange is thinned there is no particular need to form a flexible member, and the process whereby the flange comes adjacent to the companion member can be checked visually so that the ease of assembly is also improved, In other words, because it is easy to ascertain the position of the engaging mechanism, it is not inserted too far unnecessarily and the assembly operation is thus easier.

The combination alternatively may be configured in such a way that engagement is achieved by inserting a pin in the tube member and connector. The pin may be inserted through holes provided in the tube member and connector.

Where such engagement is provided, one of the holes in which the said pin is inserted may be arc-shaped to permit engagement even if the connector is at a slightly mispositioned angle; this feature improves the ease of assembly.

An arc-shaped elongated hole in which the above-mentioned pin can be inserted may be formed in either the tube member or the connector.

The constituent parts can be simplified by the use of a pin to eliminate looseness between the tube member and the connector.

Other features of the invention will be apparent from the following description of several preferred embodiments shown by way of example only in the accompanying drawings in which:

BRIEF DESCRIPTION OF THE DRAWINGS

FIGS. 18 and 19 illustrate a prior art type of connector.

DESCRIPTION OF THE PREFERRED EMBODIMENT

Figure 18:
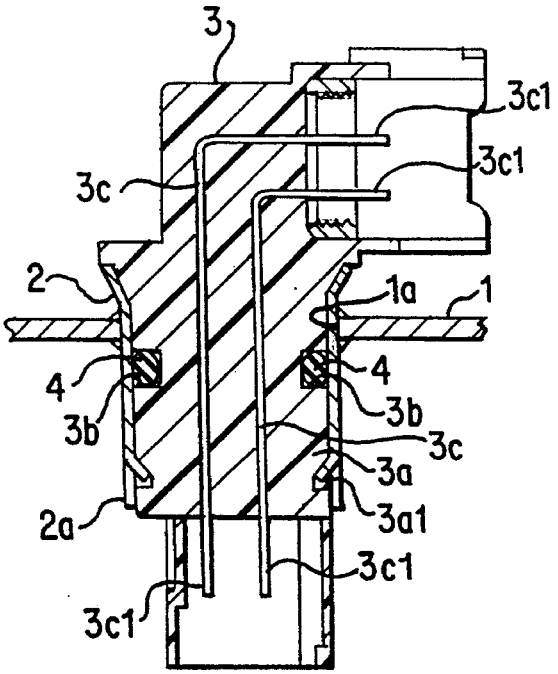
FIG. 18 PRIOR ART
FIG. 18 is a cross-section through a conventional connector.
Figure 19:
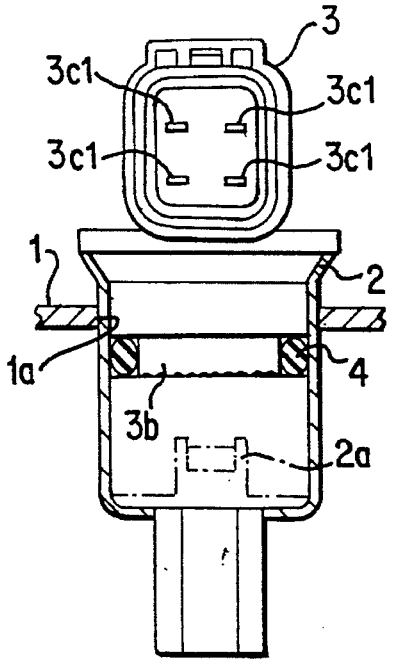
FIG. 19 PRIOR ART
FIG. 19 is another cross-section through a conventional connector.

With reference to FIGS. 18 and 19, a through hole 1*a* has been formed in the top surface panel 1 of a petrol tank, and a cylindrical tube 2 has been inserted in the through hole 1*a* in any suitable manner so that the two make contact in an airtight manner. A connector body 3 has a columnar portion 3*a* with a diameter slightly smaller than the inner diameter of the tube 2, and a toroidal channel 3*b* is formed around the circumference of the columnar portion 3*a* to accommodate an O-ring 4. Furthermore, a notched piece 2*a* is formed at the bottom end of the tube 2, and a recess 3*a*1 is formed in a position at the bottom of the columnar portion 3*a* facing the said notched piece 2*a*. Electrical wires 3*c* are formed inside the connector body 3, and both ends thereof are provided with terminals 3*c*1.

On assembly, the O-ring 4 is fitted into the recess 3*b* of the connector body 3, which is inserted in the tube 2; the O-ring ensures a tight seal between the connector and tube member. After it has been inserted to a predetermined position, the connector body 3 is turned to bring the recess 3*a*1 and the notched piece 2*a* face to face, and the said notched piece 2*a* is bent or staked so as to be pushed into the said recess 3*a*1. The notched piece 2*a* retains the connector body 3 against removal and relative rotation.

As noted above, such a construction cannot be used where the tube is made of a resin material.

Figure 1:
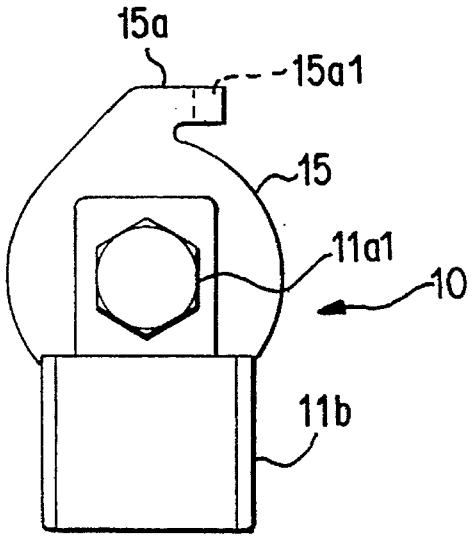
FIG. 1 is a plan view of a connector body according to the present invention.
Figure 2:
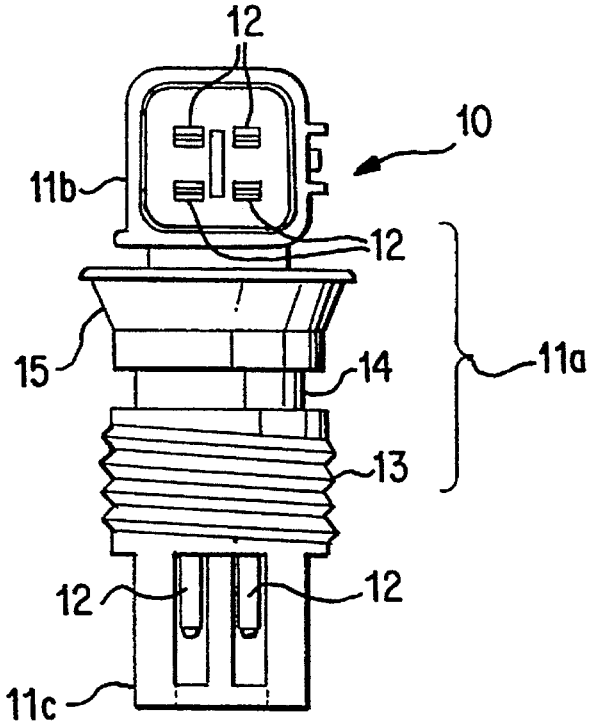
FIG. 2 is a front elevation of the connector body of FIG. 1.
Figure 3:
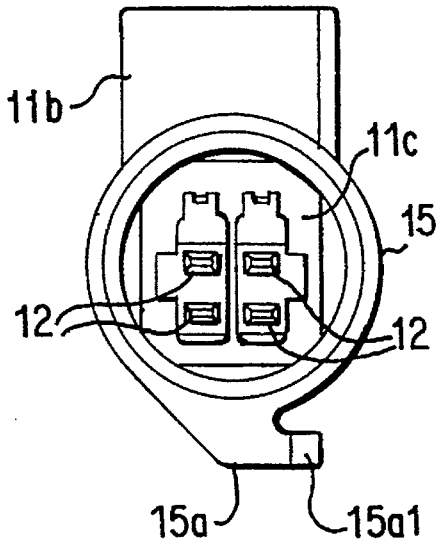
FIG. 3 is a view of underside of the connector body of FIG. 1.
Figure 4:
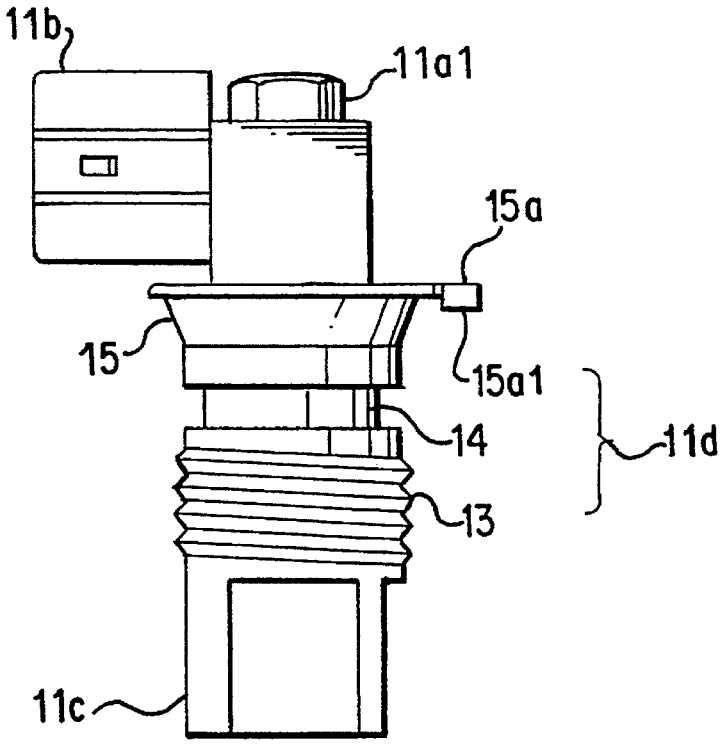
FIG. 4 is a side elevation of the connector body of FIG. 1.
Figure 5:
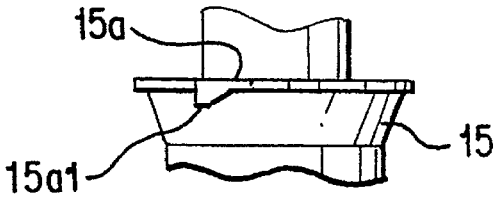
FIG. 5 is a rear elevation of part of the lid portion of theirconnector body of FIG. 1.
Figure 7:
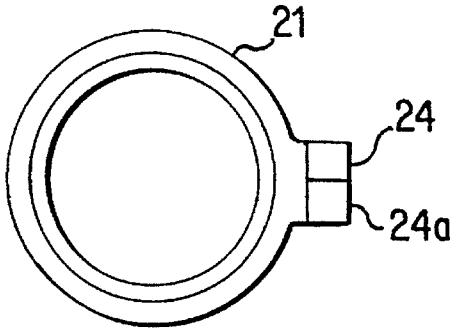
FIG. 7 is a plan view of the tube of FIG. 6.
Figure 6:
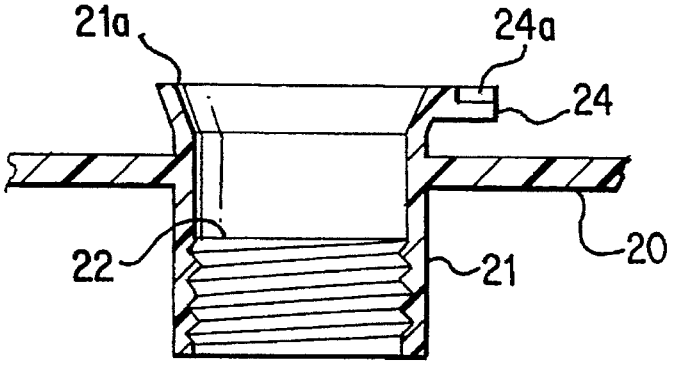
FIG. 6 is a cross-section through a tube for use with the embodiment of FIG. 1.
Figure 8:
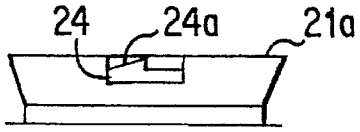
FIG. 8 is a rear elevation of part of the opening of the tube of FIG. 6.
Figure 9:
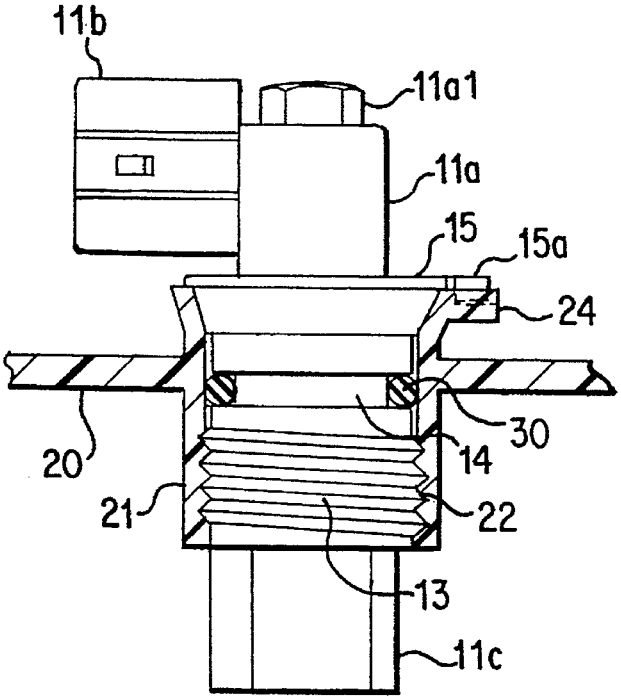
FIG. 9 is a partial cross-section through the tube and the connector body in the assembled state.
Figure 10:
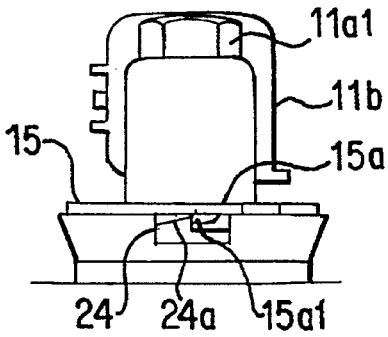
FIG. 10 is a partial rear elevation of the tube and the connection body in the assembled state.
Figure 11:
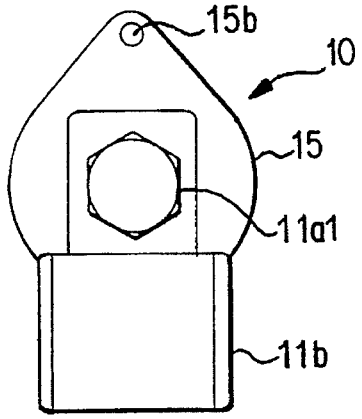
FIG. 11 is a plane view of a connector body according to another embodiment of the invention.
Figure 12:
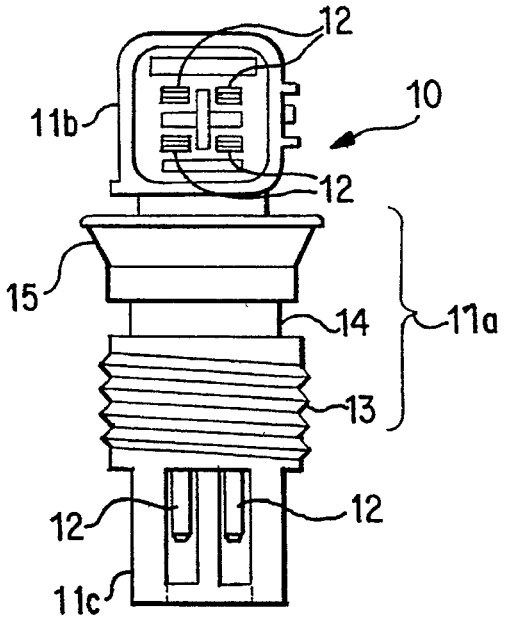
FIG. 12 is a front elevation of .the connector body of FIG. 11.
Figure 13:
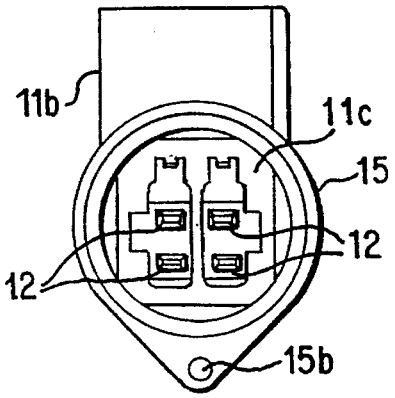
FIG. 13 is a view of the underside of the connector body of FIG. 11.
Figure 14:
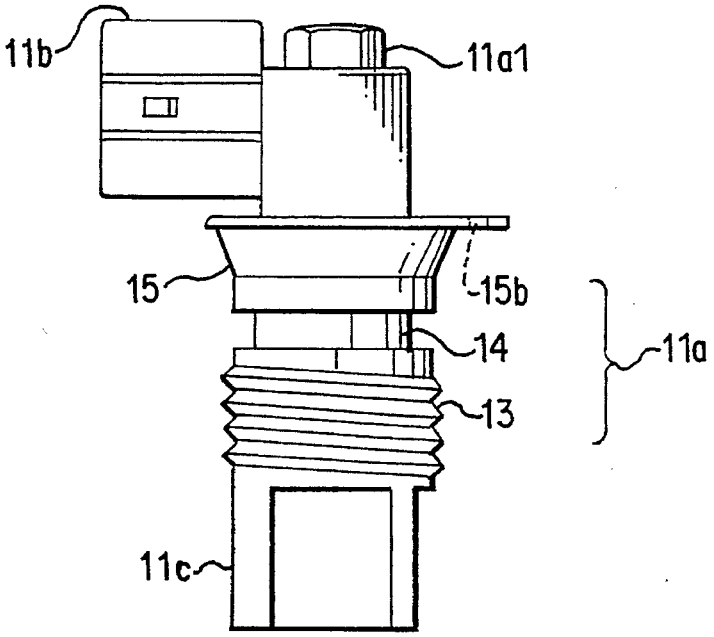
FIG. 14 is a right-side elevation of the connector body of FIG. 11.
Figure 16:
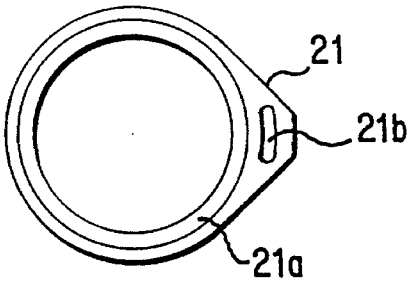
FIG. 16 is a plan view of the tube of FIG. 15.

FIG. 1 to FIG. 5 show a connector 10 according to the present invention, and FIG. 6 to FIG. 8 show the top. surface panel of a petrol tank 20.

The connector 10, which has a wiring path laid out on its inside, is provided with hoods 11*b* and 11*c* for receiving companion connectors at the top end and the bottom end of the body 11*a*, and electrical terminals 12 are provided exposed inside the hoods 11*b* and 11*c*. The upper hood 11*b* opens in the horizontal direction, and the lower hood 11*c* opens downwards, so that the connector 10 has an essentially inverted L shape overall. The connector is provided with an external male screw 13 wherein the thread is formed on the outer circumference in the lower portion of the body 11*a*. Above the male screw 13 a peripheral channel 14 is formed. A hexagonal bolt-shaped projection 11*a*1 is formed in the top surface of the body 11*a;* the projection 11*a*1 may be used to rotate the connector when fastening with a substantial force or when automating the fastening operation.

The area between the channel 14 and the hood 11b is provided with a lid portion 15 which forms a tapering inclined surface, the diameter of which becomes gradually larger from the bottom to the top, and which extends diametrally outwards in a flange shape at the top, as illustrated. An arm 15*a* is formed at the edge of the flange portion and on the opposite side to the upper hood 11*b*. The tip of the arm 15*a* is curved in the clockwise direction and on its under surface is formed a catch projection 15*a*1 in the shape of a wedge projecting towards the rear as illustrated in FIG. 5. It should be noted that because the tip of the arm 15*a* is curved in the clockwise direction (when viewed from above), the screwing-in direction is easy to ascertain.

The connector 10 is moulded from a resin, and, in particular, the arm 15*a* on the flange portion is flexible in the up and down direction to permit engagement of the catch projection 15*a*1.

With reference to FIGS. 6–8, a tube 21 having a circular opening is formed in the top panel of a petrol tank. A female screw portion 22 is formed by forming a screw thread on the inner circumferential surface of the tube 21, and the vicinity of the opening 21*a* to the top of the tube 21 is formed with an outwards taper such that the diameter becomes gradually-greater towards the top.

A lock 24 is formed projecting radially in part of the edge of the opening 21*a* and, as shown in FIG. 8, formed on the top surface of the lock 24 is a wedge-shaped catch projection 24*a* provided with an inclined surface projecting gradually upwards in the screwing direction. The top panel of the petrol tank 20 is also formed of a resin, and the tube 21 and the wall area surrounding it are integrally moulded.

The channel 14 of the connector 10 houses an O-ring 30 which is of a size such that it is slightly compressed between the channel 14 and the inner circumferential wall of the tube 21 when it is inserted. It should be noted that, apart from the O-ring held on the outer circumference of the connector 10, the maintenance of the seal between the connector 10 and the inner circumferential surface of the tube 21 can be arranged in such a way that the O-ring is held in the opening 21a and is pushed in by the flange portion of the lid 15.

Assembly of the present embodiment is now described.

First, an O-ring 30 is stretched into the channel 14 of the connector 10 which is then inserted in the tube 21 of the petrol tank 20, lower hood 11*c* first. As the connector 10 is gradually inserted, the thread of the male screw 13 makes contact with the thread of the female screw 22. Once they have come into contact, the connector 10 is rotated so that the male thread 13 engages the female thread 22.

The O-ring 30 provided in the channel 14 is initially outside the opening 21*a* of the tube 21, but as the connector 10 gradually progresses into the tube 21 as the connector 10 is turned, the O-ring 30 is gradually compressed inwards as it slides along the tapering inclined surface of the opening 21*a* and it finally enters into the tube 21. Because the O-ring 30 is slightly compressed inside the tube 21 due to the inner circumferential wall of the tube 21 and the inner circumferential wall of the channel 14 as described above, this portion is sealed.

As the connector 10 progresses into the tube 21, the lid portion 15 approaches the opening 21*a* of the tube 21. Meanwhile, the radially projecting arm 15*a* approaches the lock 24.

The catch projection 15*a*1 formed in the bottom surface of the arm 15*a* comes into contact with the top surface of the lock 24 in the final two turns of the screw thread. The shape of the wedge of the catch projection 15*a*1, and the shape of the wedge of the catch projection 24*a* on the lock 24 are such that when they meet in the screwing-in direction the arm 15*a* flexes upwards when the catch projection 15*a*1 makes contact with the top surface of the lock 24, and the connector 10 can continue to rotate without experiencing any great resistance.

However, in the final turn of the screw thread, the amount of flexing of the arm 15*a* when the catch projection 15*a*1 of the arm 15*a* rides over the catch projection 24*a* of the lock 24 is substantial, and, after it has ridden over the catch projection 24*a*, the two catch projections 15*a*1 and 24*a* assume a state in which they grip each other firmly. The lid portion 15 of the connector 10 makes contact with the opening portion 21*a* of the tube 21, and the connector 10 cannot be screwed in further.

If the connector 10 is simply screwed into the tube 21, there is the possibility that it will come loose. However, because the two catch projections 15*a*1 and 24*a* grip each other on the final turn as described above, and the upright back surfaces of the catch projections 15*a*1 and 24*a* face each other, turning in the reverse direction is not possible. In other words, a one-way ratchet mechanism, is provided due to the directionality of the wedge-shaped catch projections 15*a*1 and 24*a*. Moreover, several catch projections may be formed around the circumference on at least one side. If this is done, turning in the reverse direction can be simply prevented whatever angle the connector 10 stops at. Furthermore, they may be formed using a plurality of parts and not integrally moulded.

For example, if a substantial force is sustained acting as if to pull out the connector 10, this force is ultimately borne by the screw thread; forces acting to turn the connector 10 are not great and can therefore be adequately withstood even by a catch projection 15*a*1 supported by a flexible arm 15*a*. The connector can be engaged by simple rotation, and there is no staking operation as there is in the prior art. Consequently, there is no need for a substantial staking force and it is possible to fasten the device by hand. Nor is there any need for the device to be made of metal since there is no staking operation, which increases the freedom of materials which can be used.

In the embodiment described above, a flexible arm 15*a* is formed on the side of the connector 10, and an immobile catch projection 24*a* is formed on the side of the tube 21, but the catch projection may be formed via a flexible arm on the side of the tube 21 and an immobile catch projection formed on the side of the connector 10. Further, the catch projections 15*a*1 and 24*a* are formed in a wedge shape, but they may also take a configuration whereby they simply project. In this case, a hole in which the projecting catch projection engages may be formed in the companion part.

The arm 25*a* is formed projecting radially from the lid portion 15 in such a way as to be flexible, but the latch may also be arranged using simply the resilience of a resin material in such a way that it locks by recovering from resilient deformation. Furthermore, the rim of the flange portion may be reduced in thickness to produce flexibility by means of the thin plate construction.

The tube 21 and the periphery are formed by integral moulding, but the tube 21 and the petrol tank may be formed separately and attached in an air-tight fashion by adhesive, welding or the like.

In this way, a male thread 13 is formed on the outer circumferential surface of the connector 10, a female thread 22 is formed on the inner circumferential surface of the tube 21, and the two are screwed together to prevent withdrawal. A catch projection 15*a*1 is provided on the bottom surface of the arm 15*a* formed on the side of the connector 10, arranged in such a way that it allows turning in the fastening direction with respect to the catch projection 24*a* of the lock member 24 formed on the edge of the opening 21*a*, and does not allow turning in the reverse direction. In other words, it is arranged in such a way that when the connector 10 is screwed together with the tube 21, the two catch projections 15*a*1 and 24*a* engage and they do not permit rotation in the reverse direction and thus loosening.

FIG. 11 to FIG. 17 show another embodiment of the present invention. In the embodiment described above the arm 15*a* having the wedged-shaped catch projection 15*a*1 is formed on the side of the connector 10, and the lock member 24 having the catch projection 24*a* on the edge of the opening 21*a* is formed on the side of the tube 21, and, when the connector 10 and the tube 21 are screwed together, the two catch projections 15*a*1 and 24*a* catch and prevent unscrewing. On the other hand, in the second embodiment a pin 40 is used, and the pin 40 prevents loosening by engaging the connector 10 and the tube 21.

Figure 15:
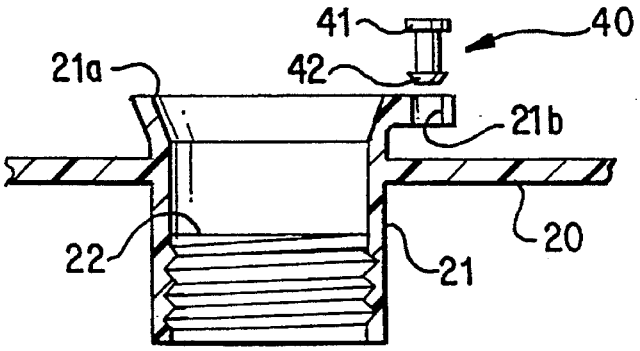
FIG. 15 is a cross-section through a tube for use with the embodiment of FIG. 11.
Figure 17:
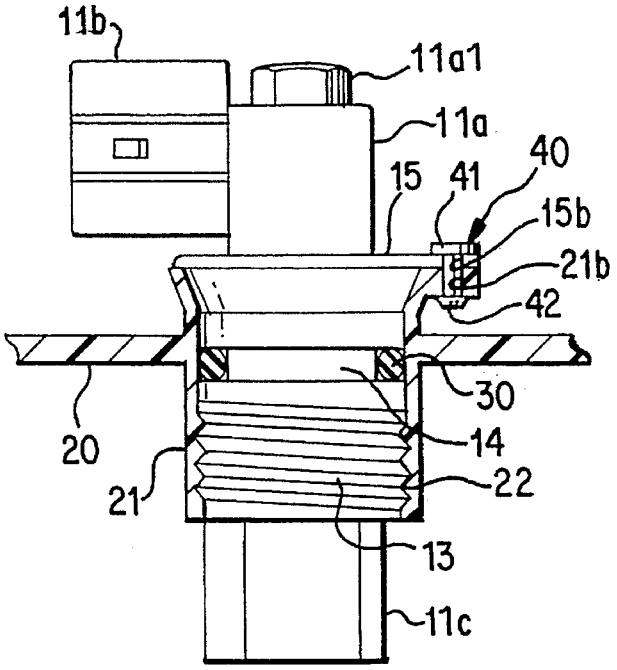
FIG. 17 is a partial cross-section through the tube of FIG. 15 andthe connector of FIG. 11 in the assembled state.

In the figures, a through hole 15*b* is formed in the top-to-bottom direction at the end of the flange of the lid portion 15 of the connector 10, and an arc-shaped elongated hole 21*b* is formed in a position facing the through hole 15*b* in the periphery of the opening 21*a*. As shown in FIG. 15, a pin 40 has a flat rim 41 formed at one end and has a stop portion 42, rather like a truncated arrow head, formed at the other end; the central portion is roughly equal to the inner diameter of the above-mentioned through hole 15*b* and elongated hole 21*b* and rather less than the diameter of the rim 41 and stop portion 42, as illustrated.

The turning angle of the connector 10 is arranged in such a way that the through hole 15*b* of the connector body 10 overlaps the elongated hole 21*b* when the connector 10 has been inserted in the tube 21 and has been screwed in until the tapering surface of the lid portion 15 has made contact with the mouth 21*a* of the tube 21. When the two overlap, the pin 40 is inserted into the through hole 15*b* of the connector 10, arrowhead portion first, until it passes through the elongated hole 21*b*.

If the connector body turns due to vibrations or the like, there is no substantiai loosening because the pin 40 runs through the two parts. In this embodiment in particular, because the through hole formed in the side of the tube 21 is arranged as an arc-shaped elongated hoe 21, the angle of the connector may be somewhat mispositioned and the pin 40 can still be inserted, which improves the ease of assembly. Of course, the elongated hole may also be on the connector body 10 as an alternative.

I claim:

1. An electrical connector provided with terminals and a body in combination with a tube member which extends through and is fixed to a wall and is provided with a mouth for receiving the electrical connector, the tube member having an internal thread and the connector having an external thread for engagement therewith to secure said connector in said wall such that terminals are located on each side of said wall, wherein the connector and tube member have a seal therebetween, and engagement means to limit relative rotation thereof to prevent removal of said electrical connector from said tube member, said engagement means being engageable on contact between the mouth of said tube member and a portion of the body of said connector.

2. The combination of claim 1 wherein said seal comprises an O-ring in a groove of said connector.

3. The combination of claim 1 wherein said engagement means comprises a ratchet mechanism which permits said tube member and connector to be screwed together but prevents unscrewing thereof.

4. The combination of claim 3 wherein said ratchet means comprises a radial arm of one of said connector and tube member, the radial arm having a projection for engagement with a catch member of the other of the connector and tube member, the projection and catch member having ramp faces to permit relative rotation in the in-screwing direction.

5. An electrical connector in combination with a tube member of or for a wall, the tube member having an internal thread and the connector having an external thread for engagement therewith, wherein the connector and tube member have a seal therebetween, and engagement means to limit relative rotation thereof, said engagement means being engageable on contact between the mouth of said tube member and a portion of the body of said connector, wherein said engagement means comprises a ratchet mechanism which permits said tube member and connector to be screwed together but prevents unscrewing thereof, wherein said ratchet means comprises a radial arm of one of said connector and tube member, the radial arm having a projection for engagement with a catch member of the other of the connector and tube member, the projection and catch member haying ramp faces to permit relative rotation in the in-screwing direction, wherein said radial arm is provided on a flange of one of said connector and tube member.

6. An electrical connector in combination with a tube member of or for a wall, the tube member having an internal thread and the connector having an external thread for engagement therewith, wherein the connector and tube member have a seal therebetween, and engagement means to limit relative rotation thereof, said engagement means being engageable on contact between the mouth of said tube member and a portion of the body of said connector, wherein said engagement means comprise an aperture of said tube member, an aperture of said connector, and a pin insertable through said apertures.

7. The combination of claim 6 wherein one of said apertures is arcuate.

8. The combination of claim 7 wherein said arcuate aperture is formed in said tube member.

9. The combination of claim 6 wherein said pin includes one-way latch means to prevent removal thereof on engagement on said apertures.

10. The combination of claim 9 wherein said pin is substantially cylindrical, said one-way latch means comprising enlarged heads at either end of the pin, and one of said heads being adapted for snap-fit engagement through at least one of said apertures.

* * * * *